US008281530B2

(12) United States Patent
Chaussee et al.

(10) Patent No.: US 8,281,530 B2
(45) Date of Patent: Oct. 9, 2012

(54) STARTER ELEMENT FOR STACKABLE INTER-ENGAGING BRICKS

(75) Inventors: Dominic Chaussee, Montréal (CA); Luis Trelles Turgeon, Montreal (CA); Simon Gauthier, Rosemère (CA)

(73) Assignee: Novabrik International Inc., Montreal (CA)

( * ) Notice: Subject to any disclaimer, the term of this patent is extended or adjusted under 35 U.S.C. 154(b) by 517 days.

(21) Appl. No.: 11/813,316

(22) PCT Filed: Jan. 4, 2006 (Under 37 CFR 1.47)

(86) PCT No.: PCT/CA2006/000009

§ 371 (c)(1), (2), (4) Date: Aug. 27, 2008

(87) PCT Pub. No.: WO2006/072174

PCT Pub. Date: Jul. 13, 2006

(65) Prior Publication Data

US 2009/0205281 A1 Aug. 20, 2009

(30) Foreign Application Priority Data

Jan. 5, 2005 (CA) ..... 2491512
Jan. 4, 2006 (CA) ..... 2532105

(51) Int. Cl.
*E02D 27/00* (2006.01)
*E04B 1/02* (2006.01)

(52) U.S. Cl. ..... 52/293.3; 52/741.1; 52/564; 52/290

(58) Field of Classification Search ..... 52/169.5, 52/58, 293, 747.1, 745.09, 293.1, 302.4, 52/302.3, 564, 293.3, 290
See application file for complete search history.

(56) References Cited

U.S. PATENT DOCUMENTS

| | | | | | |
|---|---|---|---|---|---|
| 1,624,121 | A | * | 4/1927 | Thiem | 52/371 |
| 3,638,374 | A | * | 2/1972 | Harby | 52/100 |
| 4,409,766 | A | * | 10/1983 | Blackmore | 52/169.11 |
| 5,501,044 | A | * | 3/1996 | Janesky | 52/169.5 |
| 5,501,050 | A | * | 3/1996 | Ruel | 52/513 |
| 5,836,135 | A | * | 11/1998 | Hagan et al. | 52/836 |
| 5,916,095 | A | * | 6/1999 | Tamlyn | 52/58 |
| 5,946,870 | A | * | 9/1999 | Bifano et al. | 52/254 |
| 5,970,671 | A | * | 10/1999 | Bifano et al. | 52/254 |
| 5,979,123 | A | * | 11/1999 | Brockman | 52/101 |
| 6,023,892 | A | * | 2/2000 | Sourlis | 52/169.5 |
| 6,108,995 | A | * | 8/2000 | Bouchard et al. | 52/609 |
| 6,119,429 | A | * | 9/2000 | Bifano et al. | 52/831 |

(Continued)

FOREIGN PATENT DOCUMENTS

CA 2220413 5/1996

(Continued)

*Primary Examiner* — Khoi Tran
*Assistant Examiner* — Jason Holloway
(74) *Attorney, Agent, or Firm* — Brouillette & Partners; François Cartier; Robert Brouillette

(57) ABSTRACT

A starter element for stackable inter-engaging bricks, blocks and stones for building mortarless walls is disclosed. The starter element comprises an horizontally extending strip having a first portion customized to be adjustably attached to a structure, a second portion having an upper part with an interlock element projecting upwardly therefrom to be in engagement with the mortise interlock element of the brick and a third portion sloping downwardly from the interlock element to be in at least partial contact with an inside surface of the brick. The starter element can also comprise means adapted to allow the drainage of water and the passage of air behind the wall.

39 Claims, 7 Drawing Sheets

U.S. PATENT DOCUMENTS

| | | | | |
|---|---|---|---|---|
| 6,192,639 | B1 * | 2/2001 | Germain | 52/293.1 |
| 6,253,518 | B1 * | 7/2001 | Azar | 52/589.1 |
| 6,269,591 | B1 * | 8/2001 | Kelly | 49/482.1 |
| 6,298,609 | B1 * | 10/2001 | Bifano et al. | 52/58 |
| 6,467,229 | B2 * | 10/2002 | Azar | 52/589.1 |
| 6,591,559 | B2 * | 7/2003 | Contreras et al. | 52/101 |
| 6,606,835 | B1 * | 8/2003 | Bilka | 52/604 |
| 7,383,669 | B2 * | 6/2008 | Morse | 52/545 |
| 7,621,079 | B2 * | 11/2009 | Takagi et al. | 52/169.5 |
| 2001/0029719 | A1 * | 10/2001 | Azar | 52/589.1 |
| 2002/0139060 | A1 * | 10/2002 | Contreras et al. | 52/101 |
| 2006/0101784 | A1 * | 5/2006 | Price | 52/782.1 |

FOREIGN PATENT DOCUMENTS

| | | |
|---|---|---|
| CA | 2257032 | 12/1998 |
| CA | 2285832 | 10/1999 |
| CA | 2511008 | 10/2004 |
| CA | 2523497 | 10/2004 |

* cited by examiner

STARTER ELEMENT FOR STACKABLE INTER-ENGAGING BRICKS

FIELD OF THE INVENTION

The present invention relates to a stackable inter-engaging bricks, blocks, stones and the like for building mortarless walls and more particularly to a starter element for stackable inter-engaging ricks, blocks, stones and the like.

BACKGROUND OF THE INVENTION

Stackable inter-engaging bricks for building mortarless walls or the like are known in the art. Wall building blocks which may be stacked and interlocked without being held together by a binding agent such as mortar are known. One such block has a top face which comprises a tongue element and a bottom face which comprise a mortise element. Both elements are configured in such way that when like blocks are stacked, the bottom face of a block engages with the top face of a like block disposed below while the top face of the block engages with the bottom face of an above-disposed block. An example of such blocks is shown in U.S. Pat. No. 6,108,995 (Bouchard et al).

Most commonly, the first step in building mortarless walls is the installation of a starter element to a structure (by screws, nails, or other fasteners) into a predetermined position (usually, it is a horizontal position). The starter element is a very important starting base for a lowest row or course of bricks. Typically the starter element is a longitudinally extending slightly modified metal angle or L-beam. Sometimes the first row is made of specially designed base or foot bricks that are simply placed on a base made of wood, metal or concrete on which the base or foot brick is settled.

Such elements are heavy, are difficult to cut to the desired length and are costly to install.

Thus, there is a need to develop a starter element for stackable inter-engaging bricks which is lightweight, cheap, can be easy installed and allows quick and effective brick stacking onto it.

OBJECTS OF THE INVENTION

Accordingly, an object of the present invention is to provide a starter element for stackable inter-engaging bricks, blocks, stones and the like that obviates the above-mentioned disadvantages.

Another object of the present invention is to provide the starter element for stackable inter-engaging bricks, blocks, stones and the like whose installation can be done expeditiously.

Another object of the present invention is to provide the starter element for stackable inter-engaging bricks, blocks, stones and the like which can be easily installed.

A further object of the present invention is to provide the starter element for stackable inter-engaging bricks, blocks, stones and the like which is easy and cheap to manufacture.

One more object of the present invention is to provide the starter element for stackable inter-engaging bricks, blocks, stones and the like which allows the time required to build the mortarless wall.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

To attain these and other objects which will become more apparent as the description proceeds according to one aspect of the present invention, a starter element for stackable inter-engaging bricks, blocks, stones and the like for building mortarless walls is provided. Each of the bricks, blocks, stones or the like has a tongue interlock element and a mortise interlock element configured in such way that the bricks are in a mutual engagement when bricks, blocks, stones or the like are stacked one of top of the other. For ease of reference, every time the word "brick" is used hereinafter, it is to be understood to include any other similar stackable product such as blocks and stones.

The starter element comprises a first portion customized to be adjustably attached to a structure such as studs, furring or a base, a second portion having an upper part with an interlock element projecting upwardly to be in a mutual engagement with the mortise interlock element of the brick to retain the bricks along the structure, a third portion sloping downwardly from the interlock element to be in at least partial contact with the side of the brick that faces the structure. Openings are preferably provided to receive fasteners to attach the starter element to the structure in a predetermined position. These openings may also receive fasteners projecting from the inside of said bricks to secure the bricks to the structure.

The starter element can also comprise means to allow the drainage of water and the circulation of air between the structure and the wall.

The starter element is made from a sheet-like rigid material such as steel, plastic, aluminum and fiberglass or it can be extruded from plastic (preferably recycled material) such as polyvinyl chloride ("PVC") or aluminum.

Preferably, the fasteners are made as screws, nails, dowels, pins, or the like.

A method for installing a mortarless walls or the like along a structure from a series of stackable inter-engaging bricks having a tongue interlock element and a mortise interlock element configured in such way that being in a mutual engagement when bricks are stacked one of top of the other, with the use of a starter element is also provided.

The method comprises a) selecting an arbitrary reference mark on the structure, b) establishing a second mark at a distance from the reference mark to ensure a substantial level with the reference mark, c) attaching a first portion of a starter element to the structure in the substantial level by fasteners, the starter element including a first portion customized to be adjustably attached to the structure, a second portion having an upper part with an interlock element projecting upwardly therefrom to be in a mutual engagement with the mortise interlock element of the brick to retain the bricks along the structure and a third portion sloping downwardly from the interlock element to be in at least partial contact with an inside surface of the brick, d) stackably inter-engaging the brick to the starter element, e) fastening each of the bricks of the first row by a second fastener to the structure via the starter element to define a lowest row of bricks, f) stackably inter-engaging next rows of the bricks to the lowest row for building mortarless walls or the like along the structure, g) fastening at least some of the bricks of at least every fourth row to the structure.

The invention accordingly comprises the construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

DETAILED DESCRIPTION OF THE PREFERRED EMBODIMENTS

With reference to the annexed drawings, the preferred embodiments of the present invention will be herein described for indicative purposes and by no means as of limitation.

The drawings and the description attached to it are only intended to illustrate the idea of the invention. As to the details, the invention may vary within the scope of the claims. So, the shape or size of the starter element 10 may be formed as desired, considering the needs and specifics of the wall 6 and bricks 1.

As best shown in FIGS. 1 through 4, a first embodiment of the present invention is a starter element for stackable inter-engaging bricks and is generally indicated as 10.

Figure 1:
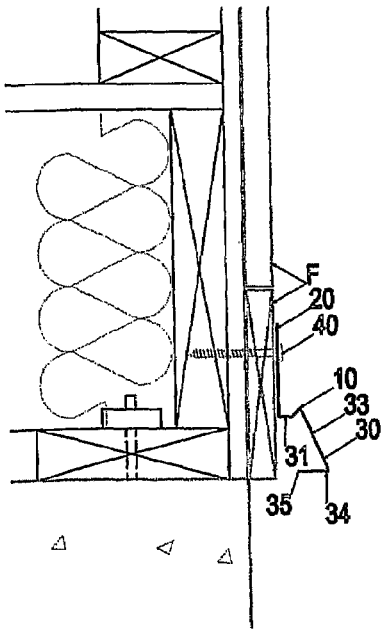
FIG. 1 is a side view of a first embodiment of the starter element for stackable inter-engaging bricks of the present invention.

Referring to FIG. 1, the starter element 10 is illustrated in a normally attached position. This starter element 10 is created to be used for building a mortarless wall 6 along a structure, for example via the furring F from the stackable inter-engaging bricks 1. The starter element 10 has a special profile which will be described below.

Figure 2:
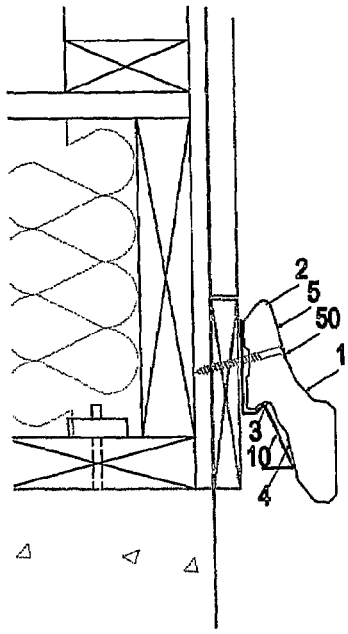
FIG. 2 is a side view of the starter element shown in FIG. 1 in inter-engaging position with the brick.
Figure 3:
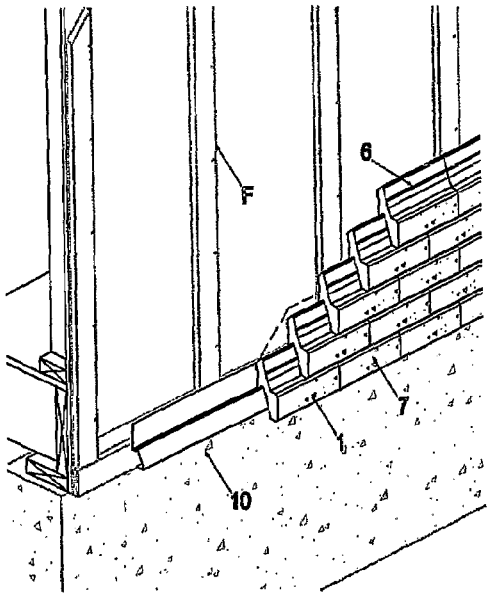
FIG. 3 is an isometric view of a mortarless wall built by stackable inter-engaging bricks with the starter element according to the present invention.
Figure 4:
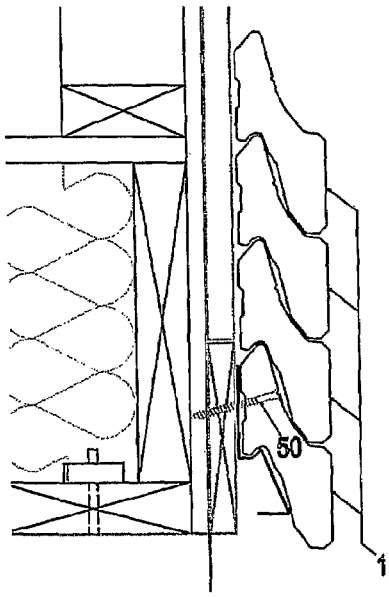
FIG. 4 is a side view of FIG. 3.

As seen in FIGS. 2, 3 and 4, each of the bricks has a tongue interlock element 2 and a mortise interlock element 3 configured in such a way that they are in a mutual engagement when bricks are stacked one of top of the other.

Referring now to FIG. 1, the starter element 10 comprises a first upper portion 20 customized to be adjustably attached to the furring F and upwardly extending from a second lower portion 30 to retain the bricks 1 along the furring F. The second lower portion 30 has an upper wall 31 with an interlock element 32 projecting upwardly from the upper wall 31 to be in a mutual engagement with the mortise interlock element 3 of said brick 1, a middle wall 33 sloping downwardly from the interlock element 32 to be in at least partial contact with the inside surface 4 of the brick 1 and a lower wall 34 extending rearwardly from the middle wall 33 towards the furring F. The fasteners 40 attach the first upper portion 20 of the starter element 10 to the furring F in a predetermined position. The starter element 10 is screwed or otherwise fastened to the furring F. It is also possible that the starter element 10 is fastened in place by nailing or other existing now or in the future fastening means. Typically, the mortarless wall 6 is built by forming a foundation in place and then attaching the starter element 10 about this foundation to start stacking the inter-engaging bricks 1.

Second fasteners 50 are used to secure an upper section 5 of at least one of the stackable bricks 1 to the furring F via the starter element 10.

The starter element 10, 110 or 210 is made from relatively thin and rigid sheet-like material such as, steel, aluminum, plastic, fiberglass, laminated materials, etc.

It is preferable, that the free end 35 of the lower wall 34 be located at a certain distance from the furring F. This distance is, in this example, between 1 to 15 mm which allows defining starting element's 10 resilient flexibility that is enough to adapt the mortise interlock element 3 of the brick 1. The middle wall 30 is customized shorter than the furring-facing surface 4 of the brick 1 such that the starter element 10 will be masked from view once the bricks are installed thereon.

The middle wall 33 may have any shape that generally matching at least partially that of the furring-facing surface 4 of the brick 1.

The fasteners 40 and 50 can be nails, screws, bolts, dowels, pins, or the like.

A method for installing a mortarless walls 6 or the like along a furring F from the stackable inter-engaging bricks 1 having a tongue interlock element 2 and a mortise interlock element 3 configured in such way that being in a mutual engagement when bricks 1 are stacked one of top of the other (see FIG. 4), with the use of a starter element 10 will now be described.

With reference to FIGS. 1-4 the method comprises next main steps:

a) selecting an arbitrary reference mark on said furring F (not shown), b) establishing a second mark at a distance from the reference mark to ensure a substantial level with the reference mark (not shown), c) attaching the starter element 10 to the furring F in the substantial level by fasteners 40 (see FIG. 1), d) stackably inter-engaging the brick 1 to the starter element 10 (see FIG. 2), e) fastening each of the bricks 1 by second fasteners 50 to the furring F via the starter element 10 to define a lowest row 7 of bricks 1 (see FIG. 3), f) stackably inter-engaging next rows of the bricks 1 to the lowest row 7 for building mortarless walls 6 or the like along the furring F, g) fastening at least some of the bricks 1 of at least every fourth row to the furring F (see FIG. 4); which row of bricks 1 need to be fastened depends of the particular dimensions and location of the mortarless wall 6.

Figure 5:
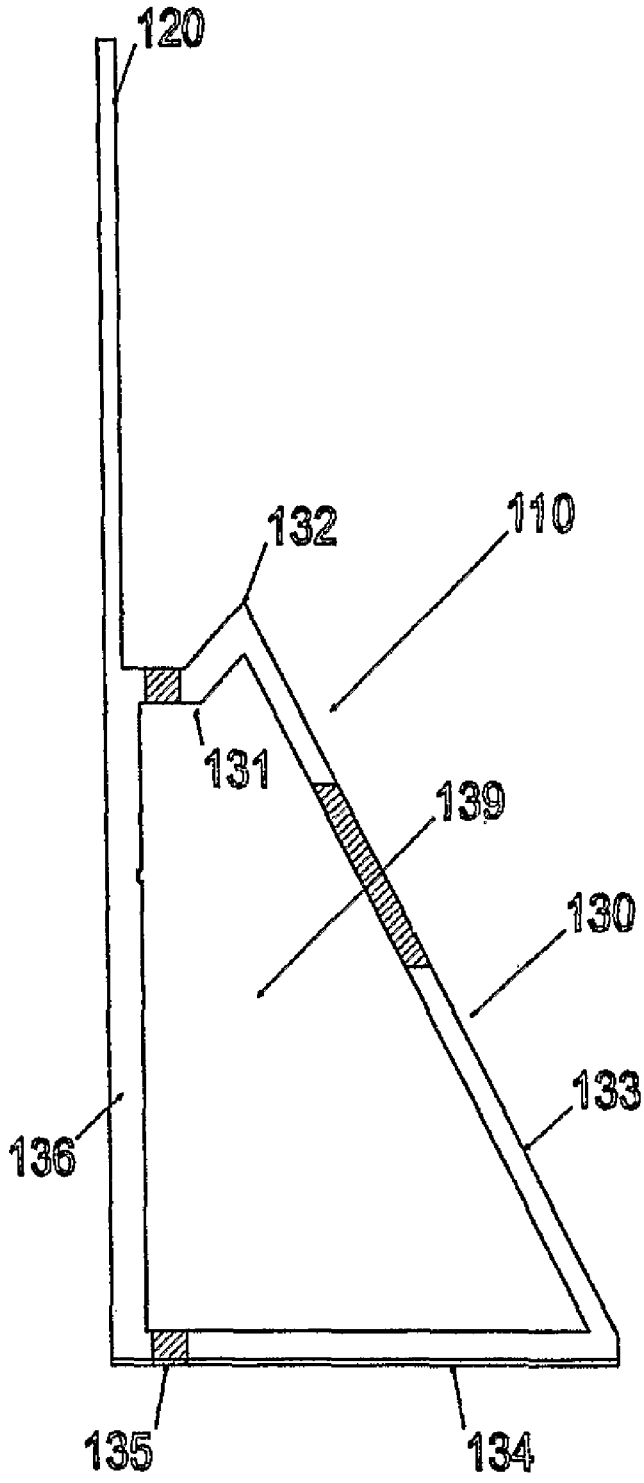
FIG. 5 is a side view of a second embodiment of the invention.
Figure 6:
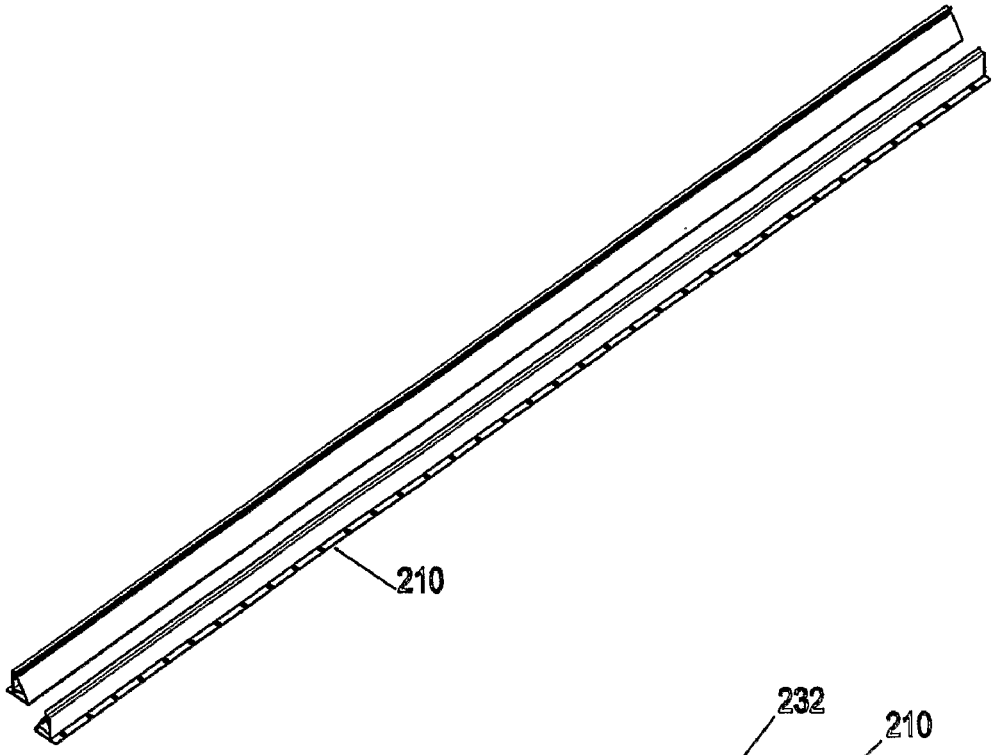
FIG. 6 is a perspective view of a third embodiment of the invention.
Figure 7:
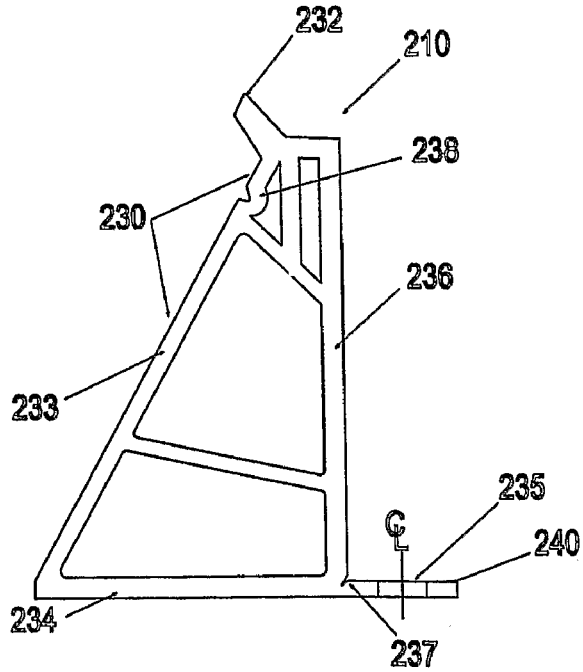
FIG. 7 is a cross-sectional view of the starter element shown in FIG. 6.
Figure 8:
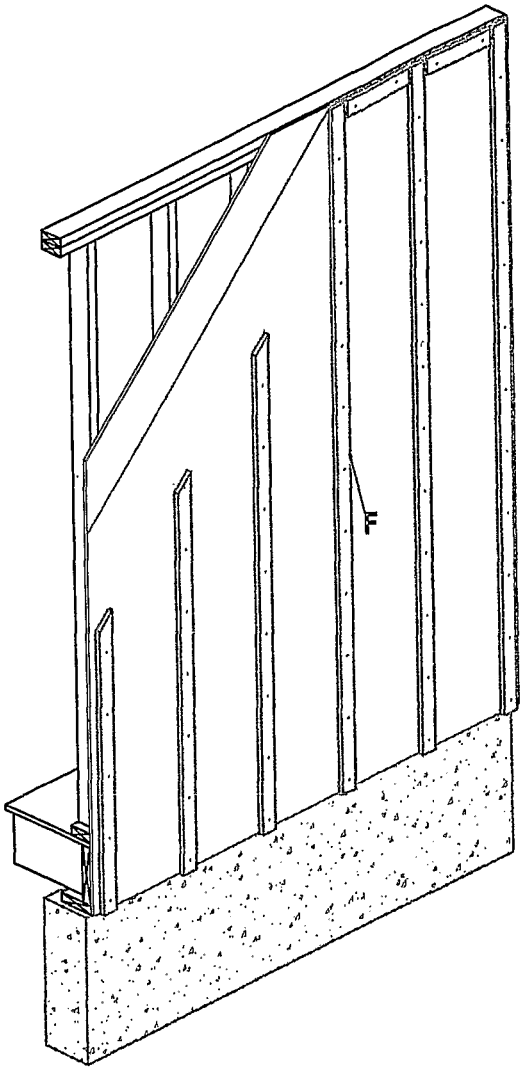
FIG. 8 is a perspective view of a typical wall ready to receive the starter element of the invention.
Figure 9:
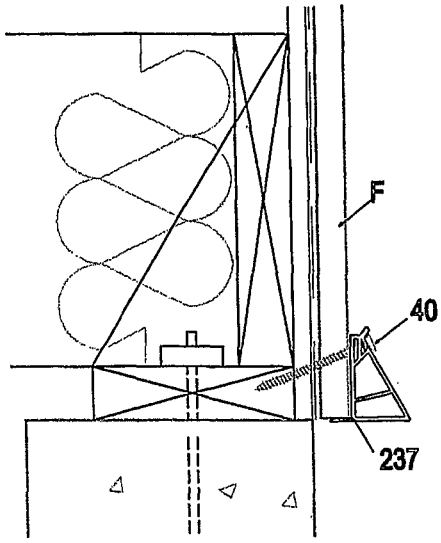
FIG. 9 is a side view of the starter element shown in FIG. 6 as installed on the wall shown in FIG. 8.
Figure 10:
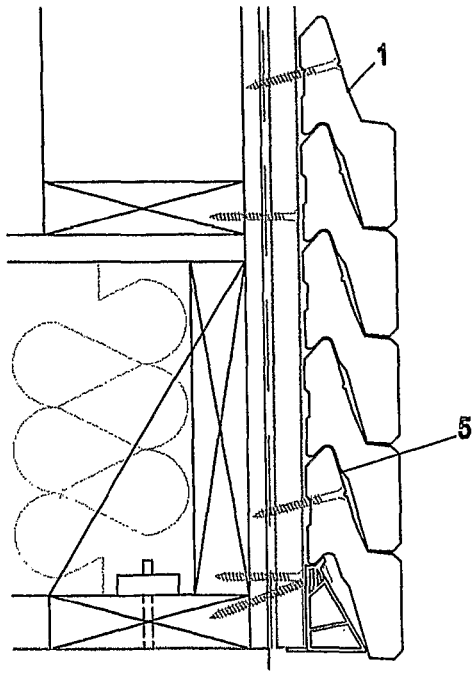
FIG. 10 is a side view of the starter element shown in FIG. 9 on which a plurality of stackable bricks have been installed.

Another embodiment of starter element 100 is shown in FIG. 5. In this embodiment, the starter element comprises a lower portion 130 and an upper portion 120 upwardly extending there from. The upper portion 120 is adapted to be attached to the wall structure (typically via furring) by screws, nails, bolts or other known means. The lower portion 130 comprises an upper wall 131 comprising an interlock element 132 projecting upwardly there from to be in mutual engagement with the mortise interlock element 3 of brick 1, a middle wall 133 sloping downwardly from the interlock element 132 to be in at least partial contact with the inside surface 4 of the brick 1 and a lower wall 134 extending rearwardly from the middle wall 133 to a vertically extending rear wall 136. A series of openings 135 are made in the lower wall 134. These openings 135 will allow any water entering into the enclosed space 139 to drain and will allow a fastener to be used to fasten the starter element to a base (not shown) or to another structural element.

A third embodiment of the invention is shown in FIGS. 6-10. In this embodiment, the starter element 210 comprises an interlock element 232 extending upwardly from a core portion 230 adapted to be in mutual engagement with the mortise interlock element 3 of brick 1. The core portion 230 is adapted to be attached to the wall structure (typically via furring) by screws, nails, bolts or other known means via holes 238. The core portion comprises a lower wall 234, a middle wall 233 sloping downwardly from the interlock element 232 to be in at least partial contact with the inside surface 4 of the brick 1 and a rear wall 236 extending vertically between the lower wall 234 and the interlock element 232. A tab 240 extends rearwardly from the rear wall 236. The tab 240 is adapted to be attached to the wall structure (typically via a base) by screws, nails, bolts or other known means via holes 235. A "V-notch" 237 is preferably disposed at the juncture of rear wall 236 and tab 240 to facilitate the removal of the tab 240 with a utility knife or the like in those instances when it is not needed.

Figures 11, 12:
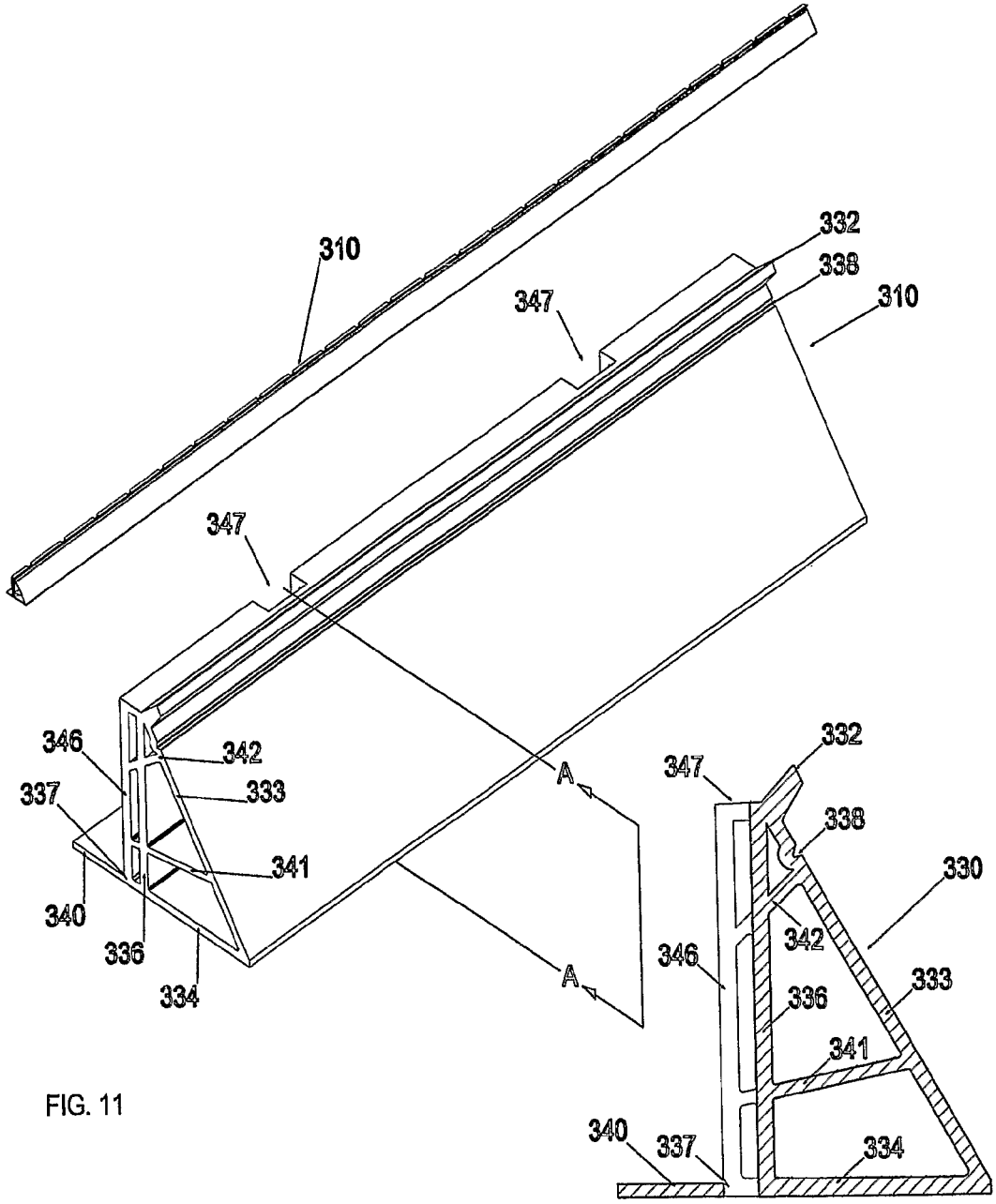
FIG. 11 is an isometric view of a fourth embodiment of the invention.
FIG. 12 is a cross-sectional side view of the starter element of FIG. 11 along line A-A.
Figure 13:
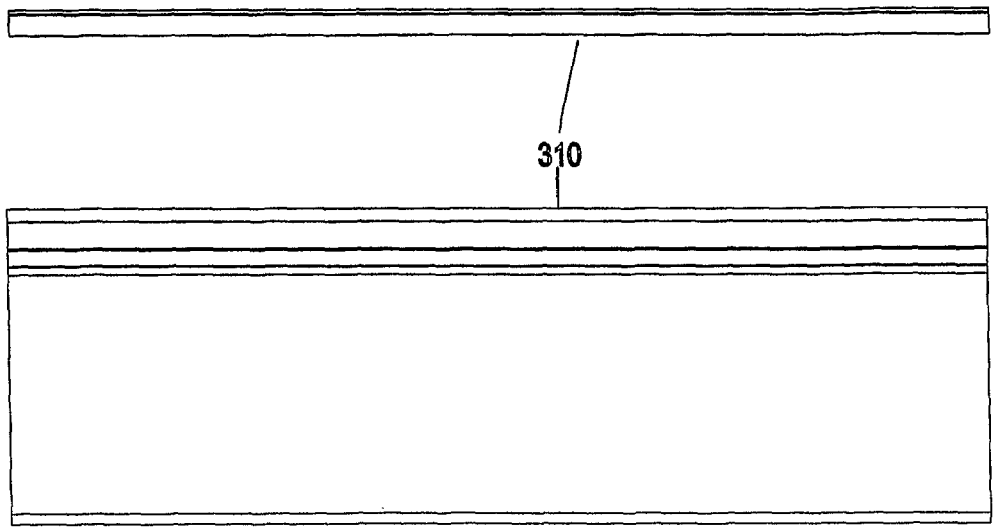
FIG. 13 is a front view of the starter element of FIG. 11.

A fourth embodiment 310 of the starter strip of the present invention is shown in FIGS. 11 to 15 and more particularly in FIGS. 11 and 12. This fourth embodiment 310 is relatively similar to the embodiment 210. However, the starter strip 310 is adapted to allow the passage of air and/or water between the starter strip 310 and the structure onto which the wall 6 of bricks 1 is built. This starter strip 310 can thus be installed onto the structure without the need of furring F and/or other similar structure.

Now referring to FIGS. 11 and 12, we can see in more details the construction of the starter strip 310. The skilled addressee will note the relative similarity between the starter strip 210 and the starter strip 310. Thus, as for starter strip 210, starter strip 310 generally comprises a main or core portion 330 adapted to be attached to the wall structure by screws, nails, bolts or other known fasteners via holes 338. Extending from the core portion 330 is a top interlocking portion 332 adapted to engage the mortise element 3 of the brick 1. Sloping and extending downwardly from the interlock portion 332 is a front wall 333. The front wall 333 is adapted to be in at least partial contact with the structure-facing surface of the brick 1. At the end of the front wall 333 is a generally horizontal lower wall 334 which extends rearwardly. A first back or rear wall 336 extends generally vertically between the top interlocking portion 332 and the lower wall 334. The starter strip 310 further comprises a second back or rear wall 346 extending generally vertically between the top interlocking portion 332 and the lower wall 334. As shown in FIGS. 11 and 12, the first back wall 336 is generally located between the front wall 333 and the second back wall 346.

The preserve the integrity of and to add rigidity to the starter strip 310, supporting walls 341 and 342 are preferably added between the front wall 333 and the first back wall 336 and second back wall 346. Understandably, depending on several external parameters such as the rigidity of the material of the starter strip 310 and/or the final weight of the wall 6, the number and placement of the supporting walls 341 and 342 can change.

Finally, a tab 340 extends generally rearwardly from the lower wall 334. The tab 340 is adapted to be attached to the wall structure (typically via a base) by screws, nails, bolts or other known means via holes (not shown). At the juncture point between the tab 340, the lower wall 334 and the second back wall 346, there is a V-notch or groove 337 generally extending laterally along the starter strip 310. This notch or groove 337 allows for the easy removal of the tab 340 with a utility knife or the like in those instances when the tab 340 is not needed.

Figure 14:
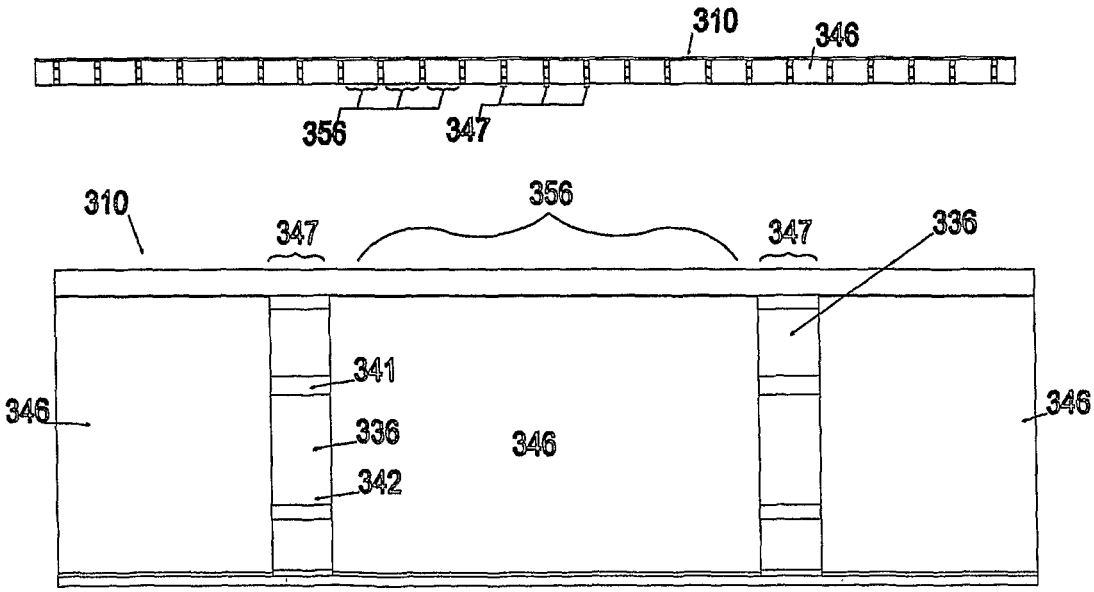
FIG. 14 is a rear view of the starter element of FIG. 11.
Figure 15:
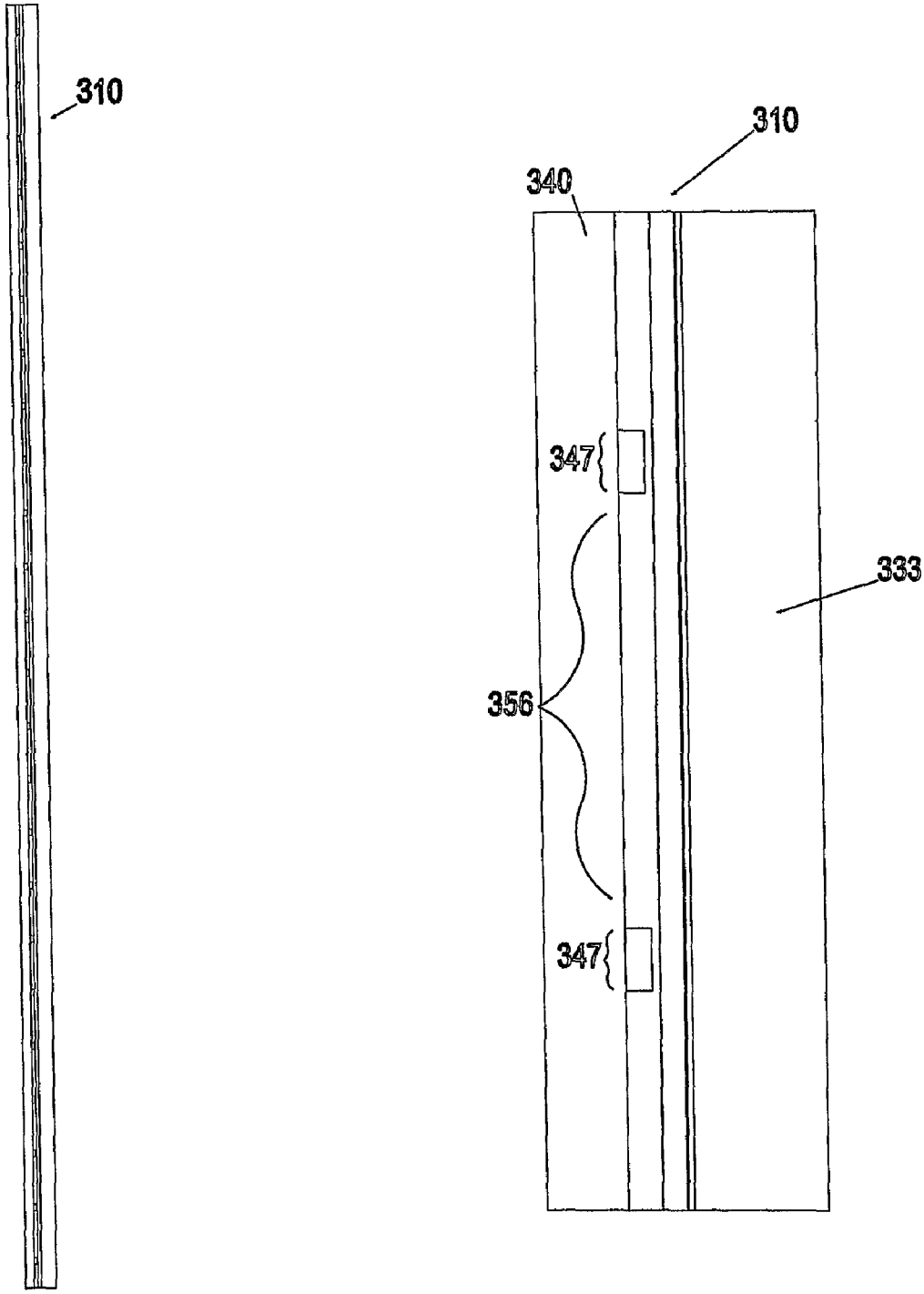
FIG. 15 is a top view of the starter element of FIG. 11.

As best shown in FIGS. 11 and 12 and also in FIGS. 14 and 15, the main particularity of the starter strip 310 is that the second back wall 346 does not laterally extend completely along the strip 310 whereas the first back wall 336 does extend completely along the strip 310. As shown in FIGS. 14 and 15, at generally regular intervals 356, there is no second back wall 346. The starter strip 310 therefore comprises generally laterally extending sections where the second back wall 346 is present and generally laterally extending sections where the second back wall 346 is absent. These absences of second back wall 346 create drainage and/or ventilation cavities or channels 347 which generally allow for the drainage of water and/or the circulation of air. These drainage/ventilation channels 347 therefore serve to prevent the accumulation of water between the structure and the wall 6 and also allow for the passage of air between the structure and the wall 6.

As shown in FIG. 12, the channel 347 extends from the top portion 332 to the lower wall 334. Any water that might be present between the structure and the wall 6 can thus drain through the strip 310 and toward the ground. Moreover, since air can flow between the exterior and the area between the structure and the wall 6, the exterior pressure and the pressure in the area between the structure and the wall 6 is at an equilibrium.

Even though the channels 347 shown in FIGS. 11-15 are generally and preferably vertical, this is not an absolute prerequisite. Indeed, the channels 347 could be at an angle or have jagged sides. The final shape of the channels 347 is unimportant as long as the channels 347 allow a proper drainage of the water and an adequate ventilation.

Since furrings F are generally installed on the structure to create drainage and/or ventilation channels, the starter strip 310 can be installed onto the structure without the need for such furrings F. The skilled addressee will readily understand that the channels previously created by the furrings F are replaced by the channels 347 created by the regular absence of the second back wall 346.

Finally, the starter strip 310 could further comprise small drainage holes (not shown) located in the lower wall 334, the front wall 333 and/or the first back wall 336 to enhance the draining process. Moreover, these holes could be preformed and/or added upon installation of the starter strip 310. These holes would generally prevent the accumulation of water in or near the starter strip 310.

Although the present starter element for stackable interengaging bricks for building mortarless walls along a structure has been described with a certain degree of particularity, it is to be understood that the disclosure has been made by way of example only and that the present invention is not limited to the features of the embodiment(s) described and illustrated herein, but includes all variations and modifications within the scope and spirit of the invention as hereinafter claimed.

The embodiments of the invention in which an exclusive property or privilege is claimed are defined as follows:

1. A starter element for supporting stackable inter-engaging bricks for building mortarless walls along a wall structure, each of said bricks having a tongue interlock element and a mortise interlock element configured in such way that they are in a mutual engagement when bricks are stacked one on top of the other, said bricks having an inner surface facing said structure, said starter element comprising:

a. a first wall attachable to said wall structure, said first wall having a first end and a second end;

b. a second wall to support and retain said bricks along said structure, said second wall extending forwardly from said first wall and having a first end and a second end, said first end of said second wall being adjacent to said first wall, said second wall having an interlock element projecting upwardly from said second end of said second wall to be in a mutual engagement with said mortise interlock element of said brick;

c. a third wall sloping downwardly from said interlock element to be in at least partial contact with said inner surface of said brick, said third wall having a first end and a second end, said first end of said third wall being adjacent to said interlock element; and d. a fourth wall extending between said third portion and said first portion, said fourth wall having a first end and a second end, said first end of said fourth wall being adjacent to said third wall and said second end of said fourth wall being adjacent to said first wall.

2. The starter element according to claim 1, and including fastener openings in said first wall to secure at least some of said stackable bricks to said structure via said starter element.

3. The starter element according to claim 1, wherein said starter element is made from a substantially rigid sheet-like material.

4. The starter element according to claim 3, wherein said material is chosen from steel, aluminum, plastic and fiberglass.

5. The starter element according to claim 1, wherein said third wall has a shape generally adapted to match at least partially that of said inner surface of said brick.

6. The starter element according to claim 5, wherein said third wall is adapted to be shorter than said inner surface of said brick.

7. The starter element according to claim 1, further comprising a fifth wall extending substantially vertically between said fourth wall and said second wall, said fifth wall having a first end adjacent to said fourth wall and a second end adjacent to said second wall, said fifth wall being located between said first wall and said third wall.

8. The starter element according to claim 1, wherein said first wall comprises at least one drainage/ventilation channel defining a space between said starter element and said structure.

9. The starter element according to claim 8, wherein said at least one drainage/ventilation channel extends generally vertically.

10. A starter element for supporting stackable inter-engaging bricks for building mortarless walls along a structure, each of said bricks having a tongue interlock element and a mortise interlock element configured in such way that they are in a mutual engagement when bricks are stacked one of top of the other, said bricks having an inner surface facing said structure, said starter element comprising:

a. a first wall attachable to said structure, said first wall having a first end and a second end;

b. a second wall to support and retain said bricks along said structure, said second wall extending forwardly from said first wall and having a first end and a second, said first end of said second wall being adjacent to said first wall, said second wall having an interlock element projecting upwardly from said second end of said second wall to be in a mutual engagement with said mortise interlock element of said brick;

c. a third wall sloping downwardly from said interlock element to be in at least partial contact with said inner surface of said brick, said third wall having a first end and a second end, said first end of said third wall being adjacent to the interlock element;

d. a fourth wall extending rearwardly between said third wall and said first wall, said fourth wall having a first end adjacent to said third wall, and a second end adjacent to said first wall; and e. a fifth wall extending substantially vertically between said fourth portion and said second portion, said fifth wall having a first end adjacent to said fourth wall, and a second end adjacent to said second wall.

11. The starter element according to claim 10, and including fastener openings in said first wall to secure at least some of said stackable bricks to said structure via said starter element.

12. The starter element according to claim 10, wherein said starter element is made from a rigid sheet-like material.

13. The starter element according to claim 12, wherein said material is chosen from steel, aluminum, plastic and fiberglass.

14. The starter element according to claim 10, wherein said third wall has a shape generally adapted to match at least partially that of said inner surface of said brick.

15. The starter element according to claim 14, wherein said third wall is adapted to be shorter than said inner surface of said brick.

16. The starter element according to claim 10, wherein said first wall comprises at least one drainage/ventilation channel defining a space between said starter element and said structure.

17. The starter element according to claim 16, wherein said at least one drainage/ventilation channel extends generally vertically.

18. The starter element according to claim 10, wherein said starter element extends generally laterally and wherein said starter element comprises laterally extending sections where said first wall is present and laterally extending sections where said first wall is absent, said laterally extending sections where said first wall is absent defining drainage/ventilation channels.

19. The starter element according to claim 18, wherein said drainage/ventilation channels extend through said second wall and said fourth wall.

20. A method for installing mortarless walls to a structure from stackable inter-engaging bricks having a tongue interlock element and a mortise interlock element configured in such way that they are in a mutual engagement when bricks are stacked one of top of the other, said bricks having an inner surface facing said structure, said method involving the use of a starter element comprising a first portion attachable to said structure, a second portion to support and retain said bricks along the structure, said second portion extending from said first portion and having an interlock element projecting upwardly therefrom to be in a mutual engagement with said mortise interlock element of said brick, a third portion sloping downwardly from said interlock element to be in at least partial contact with said inner surface of said brick, and a fourth portion extending between said third portion and said first portion, said method comprising the following steps:

a. selecting a first reference mark on said structure;
b. establishing a second reference mark on said structure at a distance from said first reference mark to ensure a substantial level with said first reference mark;
c. attaching said first portion of said starter element to said structure in said substantial level by a fastener;
d. stackably inter-engaging said bricks onto said starter element;
e. fastening at least some of said bricks by fasteners to said structure to define a lowest row of bricks;
f. stackably inter-engaging next rows of said bricks to said lowest row;
g. fastening at least some of said bricks of at least every fourth row to said structure.

21. A method as described in claim 20 wherein in step e), all of said bricks are fastened to said structure.

22. A method for installing mortarless walls to a structure from stackable inter-engaging bricks having a tongue interlock element and a mortise interlock element configured in such way that they are in a mutual engagement when bricks are stacked one of top of the other, said bricks having an inner surface facing said structure, said method involving the use of a starter element comprising a first portion attachable to said structure, a second portion to support and retain said bricks along said structure, said second portion extending from said first portion and having an interlock element projecting upwardly therefrom to be in a mutual engagement with said mortise interlock element of said brick, a third portion sloping downwardly from said interlock element to be in at least partial contact with said inner surface of said brick, a fourth portion extending rearwardly between said third portion and said first portion, and a fifth portion extending substantially vertically between said fourth portion and said second portion, said method comprising the following steps:

a. selecting a first reference mark on said structure;
b. establishing a second reference mark on said structure at a distance from said first reference mark to ensure a substantial level with said first reference mark;
c. attaching said first portion of said starter element to said structure in said substantial level by a fastener;
d. stackably inter-engaging said bricks onto said starter element;
e. fastening at least some of said bricks by fasteners to said structure to define a lowest row of bricks;
f. stackably inter-engaging next rows of said bricks to said lowest row;
g. fastening at least some of the bricks of at least every fourth row to said structure.

23. A method as described in claim 22 wherein in step e), all of said bricks are fastened to said structure.

24. A starter element for supporting stackable inter-engaging bricks for building mortarless walls along a wall structure, each of said bricks having a tongue interlock element and a mortise interlock element configured in such way that they are in a mutual engagement when bricks are stacked one on top of the other, said bricks having an inner surface facing said structure, said starter element comprising:

a. a first wall having a first end and a second end;
b. a second wall to support and retain said bricks along said structure, said second wall extending forwardly from said first wall and having a first end and a second end, said first end of said second wall being adjacent to said first wall, said second wall having an interlock element projecting upwardly from said second end of said second wall to be in mutual engagement with said mortise interlock element of said brick;
c. a third wall sloping downwardly from said interlock element to be in at least partial contact with said inner surface of said brick, said third wall having a first end and a second end, said first end of said third wall being adjacent to said interlock element;
d. a fourth wall extending rearwardly between said third wall and said first wall, said fourth wall having a first end adjacent to said third wall and a second end adjacent to said first wall;
e. a tab extending rearwardly from said first wall towards said structure, said tab having a first end adjacent to said first wall, and a second end.

25. The starter element as claimed in claim 24, wherein said first wall is attachable to said wall structure.

26. The starter element as claimed in claim 24, further comprising a plurality of supporting walls extending between said first wall and said third wall.

27. The starter element according to claim 24, wherein said tab is adapted to be attached to the wall structure by attachment means via holes.

28. The starter element according to claim 24, further comprising a fifth wall extending between said fourth wall and said second wall and generally parallel to said first wall, said fifth wall having a first end adjacent to said fourth wall, and a second end adjacent to said second wall.

29. The starter element according to claim 24, wherein said tab further comprise a "V-Notch" disposed at a junction of said first wall and said fourth wall.

30. The starter element according to claim 24, wherein said starter element is made from a substantially rigid sheet-like material.

31. The starter element according to claim 30, wherein said material is chosen from steel, aluminum, plastic and fiberglass.

32. The starter element according to claim 24, wherein said third wall has a shape generally adapted to match at least partially that of said inner surface of said brick.

33. The starter element according to claim 24, wherein said first wall comprises at least one drainage/ventilation channel defining a space between said starter element and said structure.

34. The starter element according to claim 33, wherein said at least one drainage/ventilation channel extends generally vertically.

35. A laterally extending starter element for supporting stackable inter-engaging bricks for building mortarless walls along a structure, each of said bricks having a tongue interlock element and a mortise interlock element configured in such way that they are in a mutual engagement when bricks are stacked one of top of the other, each of said bricks having an inner surface facing said structure, said starter element comprising:

a. a first wall attachable to said structure, said first wall having a first end and a second end;
b. a second wall to support and retain said bricks along said structure, said second wall extending forwardly from said first wall and having a first end and a second end, said first end of said second wall being adjacent to said first wall, said second wall comprising an interlock element projecting upwardly from said second end of said second wall to be in a mutual engagement with said mortise interlock element of said brick;
c. a third wall sloping downwardly from said interlock element to be in at least partial contact with said inner surface of said brick, said third wall having a first end and a second end, said first end of said third wall being adjacent to said interlock element;

d. a fourth wall extending rearwardly between said third wall and said first wall, said fourth wall having a first end adjacent to said third wall, and a second end adjacent to said first wall; and e. a fifth wall extending substantially vertically between said fourth wall and said second wall, said fifth wall having a first end adjacent to said fourth wall, and a second end adjacent to said second wall;

wherein said starter element comprises laterally extending sections where said first wall is present and laterally extending sections where said first wall is absent, each of said laterally extending sections where said first wall is absent defining a drainage/ventilation channel, each of said drainage/ventilation channels extending through at least part of said second wall and said fourth wall.

36. The starter element according to claim 35, wherein said starter element is made from a rigid sheet-like material.

37. The starter element according to claim 36, wherein said material is chosen from steel, aluminum, plastic and fiberglass.

38. The starter element according to claim 35, wherein said third wall has a shape generally adapted to match at least partially that of said inner surface of said brick.

39. The starter element according to claim 38, wherein said third wall is adapted to be shorter than said inner surface of said brick.

* * * * *